US010301896B2

(12) United States Patent
Porter

(10) Patent No.: US 10,301,896 B2
(45) Date of Patent: May 28, 2019

(54) CUTTING TOOL

(71) Applicant: Westerton (UK) Limited, East Tullos, Aberdeen (GB)

(72) Inventor: Robert Alexander Porter, East Tullos (GB)

(73) Assignee: WESTERTON (UK) LIMITED, East Tullos, Aberdeen (GB)

( * ) Notice: Subject to any disclaimer, the term of this patent is extended or adjusted under 35 U.S.C. 154(b) by 0 days.

(21) Appl. No.: 15/053,513

(22) Filed: Feb. 25, 2016

(65) Prior Publication Data

US 2016/0251924 A1 Sep. 1, 2016

(30) Foreign Application Priority Data

Feb. 26, 2015 (GB) ..... 1503267.5

(51) Int. Cl.
*E21B 29/00* (2006.01)
*E21B 23/01* (2006.01)

(52) U.S. Cl.
CPC ..... *E21B 29/002* (2013.01); *E21B 29/005* (2013.01); *E21B 23/01* (2013.01)

(58) Field of Classification Search
CPC ..... E21B 29/002; E21B 29/005
See application file for complete search history.

(56) References Cited

U.S. PATENT DOCUMENTS 2,899,000 A * 8/1959 Medders ..... E21B 29/002 166/55.8
3,283,405 A * 11/1966 Braswell ..... E21B 29/005 30/103
7,562,700 B2 * 7/2009 Lewis ..... E21B 29/005 166/298
7,575,056 B2 * 8/2009 Fuhst ..... B23D 45/128 166/298
2007/0131410 A1 6/2007 Hill et al.
2008/0092356 A1 4/2008 Fuhst et al.
2008/0236828 A1 * 10/2008 Fuhst ..... E21B 29/005 166/297

(Continued)

FOREIGN PATENT DOCUMENTS

EP 1241321 A2 9/2002
EP 2530238 A1 12/2012

(Continued)

OTHER PUBLICATIONS

The European search report for the Application No. 16157668.1, 8 pages, dated Aug. 23, 2016.

(Continued)

*Primary Examiner* — David J Bagnell
*Assistant Examiner* — Tara E Schimpf
(74) *Attorney, Agent, or Firm* — Tarolli, Sundheim, Covell & Tummino LLP

(57) ABSTRACT

A cutting tool (10) for cutting a tubular. The cutting tool (10) comprises a cutting element (18) which defines a cutting profile, a first drive mechanism (20), which is operable to rotate the cutting element (18); and a second drive mechanism (22), which is operable to control the displacement of the cutting element (18) with respect to a surface of the tubular that is to be cut. The first and second drive mechanisms (20, 22) are arranged such that they are independently powered.

14 Claims, 9 Drawing Sheets

(56) References Cited

U.S. PATENT DOCUMENTS

| | | | | |
|---|---|---|---|---|
| 2011/0192589 | A1 | 8/2011 | Fuhst et al. | |
| 2011/0209872 | A1* | 9/2011 | McAfee | E21B 44/00 166/298 |

FOREIGN PATENT DOCUMENTS

| | | | |
|---|---|---|---|
| EP | 2812665 | A | 12/2014 |
| EP | 2813665 | A1 | 12/2014 |
| GB | 2448919 | A | 11/2008 |
| WO | 9842470 | A1 | 10/1998 |
| WO | 2010066276 | A1 | 6/2010 |
| WO | 2014198897 | A1 | 12/2014 |

OTHER PUBLICATIONS

The Combined Search and Examination Report for the Application No. GB1603363.1, 6 pages, dated Jul. 19, 2016.
UK Search Report to corresponding application No. GB1503267.5, 5 pages, dated May 28, 2015.
Combined Search and Examination Report for Application No. GB1603365.6, dated Sep. 5, 2016, pp. 1-5.

* cited by examiner

CUTTING TOOL

RELATED APPLICATIONS

The present application claims priority from British Patent Application No. GB1503267.5, filed on Feb. 26, 2015, the subject matter of which is incorporated herein by reference.

FIELD OF THE INVENTION

The present invention relates to a cutting tool for cutting tubulars.

BACKGROUND TO THE INVENTION

During certain phases of well drilling and development it is necessary to cut metal tubulars within the borehole, or to remove sections of downhole components such as packers. In order to achieve this, a cutting device must be lowered inside the tubular, then operated remotely to perform a cut.

One category of conventional tools for cutting tubulars are mechanical or hydraulic cutting or punch tools which are deployed on the end of drill pipe, coiled tubing or other tubular. Such devices suffer from the disadvantage of being cumbersome, as well as expensive to purchase, deploy and operate; the operation and deployment of the devices commonly requires a complete drill rig and several days to be completed. In situations where the tubular to be cut is narrow, devices in this category may be precluded.

Typically, devices in this category incorporate a number of large blades which gouge their way through the tubular. Gouging a cut through the tubular, i.e. forcing a punch through the tubular wall, rather than performing a precision cut, suffers from the disadvantage of requiring a large amount of energy. Typically, such cutting techniques leave the cut end of the tubular in a ragged condition, which can occlude subsequent operations involving the tubular.

Furthermore, the devices, which include a mechanism for anchoring the device within a tubular, typically utilize some form of hydraulic or pneumatic means for part of the deployment of that mechanism. The use of hydraulic and/or pneumatic means results in the devices requiring multiple cables/hoses which can lead to additional deployment problems when the device is to be used in a tubular, for example, a live oil well, having a seal and airlock mechanism and/or when a cut is to be made at great depth.

The positioning of the anchoring mechanism in relation to the cutting blade also affects the quality and accuracy of achievable cut. The tool can flex around the anchoring point, and the greater the distance between the anchoring point and the cutting blade, the greater the degree of flex and, accordingly, the greater the degree of inaccuracy in the cut.

However, besides inaccuracy in the cut, the major problem when the tool flexes is that as the blade is no longer cutting perpendicular to the tubular wall there is a considerable amount of rubbing on the side of the blade. This, combined with the vibration (caused by the lack of rigidity), results in a dramatic increase in failure rate.

In particular, as the cutting tip penetrates the wall of the tubular, the flexion acts like a spring, causing the tip to press outwardly (i.e. deeper into the tubular) and this causes the drive motor to stall and at the same time the cutting tip is destroyed. This is very common with overly long heads, and particularly because the tubulars are not always round, the tip may start cutting in one side before it makes contact on the whole tubular circumference.

Within traditional machining operations the control over surface speed and feed rate allows great variety in the material which can be cut; however, within known systems the feed rate of the cutter blade is often not controlled and is simply an output of the applied force or is mechanically linked to the rotational speed of the cutter blade. In both cases variation to the feed rate cannot be adjusted while the tool is in use. This lack of control can also account for considerable wasted time during a cutting operation as the cutting blade extension rate cannot be increased while the blade is not in contact with the tubular; likewise, as the cutting blade is returned into the tool body the feed rate again cannot be increased. It is estimated that in most cases the tool is only cutting for less than 50% of the time that the cutting head is being run. This has the negative effect of generating considerable heat within the electric motors and surrounding areas, which limits the life of the motors as in some cases the environmental temperature can be in excess of 200° C.

SUMMARY OF THE INVENTION

According to a first aspect the present invention there is provided a cutting tool for cutting a tubular, the tool comprising:

a cutting element defining a cutting profile;

a first drive mechanism adapted to rotate the cutting element, and a second drive mechanism adapted to control the displacement of the cutting element with respect to a surface to be cut;

wherein the first and second drive mechanisms are independently powered.

In at least one embodiment of the present invention, providing independent drives for the mechanism which rotates the cutting element and the mechanism which advances or retracts the cutting element with respect to the surface to be cut, allows for the utilisation of the tool to be increased as the rate of advancement or retraction can be controlled, resulting in less time being wasted as the tool of the present invention is not restricted to the slow rate of advancement of conventional tools.

Furthermore, separating the drives eliminates the need for a torque limiter to be installed, as is the case where a single drive is used control both the rotation of the cutting element and the displacement of the cutting element. A torque limiter is used in these conventional tools to protect the displacement mechanism. The torque limiter in a conventional tool is positioned adjacent to the cutting element and as such increases the distance between the cutting element and the anchoring point which leads to flexing of the tool head under load.

Removing the need for the torque limiter allows the anchoring point to be much closer to the cutting element, thereby reducing the flex and providing for a much more accurate, reliable and cleaner cut.

The cutting tool may be adapted to cut a tubular from the inside.

The cutting element may be adapted to rotate around a cutting element rotational axis.

The cutting tool may further comprise a tool housing, the tool housing having a longitudinal axis.

The cutting tool may further comprise a first motor and a second motor.

The first drive mechanism may be powered by the first motor.

The second drive mechanism may be powered by the second motor.

The cutting element may be elongate. For example, the cutting element may be a drill bit.

The elongate cutting element may define a cutting element longitudinal axis.

The cutting element longitudinal axis may be at an angle to the tool housing longitudinal axis.

The cutting element longitudinal axis may be perpendicular to the tool housing longitudinal axis.

Alternatively, the cutting element longitudinal axis may be non-perpendicular to the tool housing longitudinal axis.

In other embodiments, the cutting element may be planar. The cutting element may be a circular disc such as a saw blade.

The cutting tool may further comprise a tool head, wherein the tool head is configured to contain the cutting element.

The tool head may define a tool head longitudinal axis.

The tool head may be rotationally mounted to the tool body.

The tool head may be releaseably connectable to the tool body.

In some embodiments, the cutting element is rotationally independent of the tool head. In these embodiments, the cutting element can rotate with respect to the tool head.

In these and other embodiments, the first drive mechanism and the second drive mechanism may both be adapted to move the cutting element with respect to the tool head.

In these and other embodiments, the cutting element rotational axis may be the same as the tool head longitudinal axis.

In these and other embodiments, the cutting element rotational axis may be different to the tool head longitudinal axis.

In these and other embodiments, the cutting element rotational axis may be perpendicular to the tool head longitudinal axis.

In these and other embodiments, the cutting element may be a drill bit, for example, for cutting holes in well casing or tubulars. The first drive mechanism will rotate the drill bit and the second drive mechanism will move the drill bit into engagement with the well casing or tubular surface, through the well casing or tubular wall and, upon completion, retract the bit back into the tool head.

In alternative embodiments, the cutting element is rotationally fixed with respect to the tool head. In these embodiments, rotation of the tool head creates the rotation of the cutting element.

In these alternative embodiments, only the second drive mechanism may be adapted to move the cutting element with respect to the tool head.

In these alternative embodiments, the cutting element rotational axis may be the same as the tool head longitudinal axis.

In these alternative embodiments, the first drive mechanism may be adapted to rotate the tool head with respect to the tool body. In these embodiments, the whole tool head spins and the cutting element cuts, for example, a circumferential cut in the well casing or tubular, for example. In these embodiments, the second drive mechanism advances or retracts the cutting element towards or away from the well casing or tubular to facilitate the cut.

The tool head may be adapted to rotate around tool head longitudinal axis.

During rotation of the tool head, the tool head longitudinal axis may be the same as the tool housing longitudinal axis.

In alternative embodiments, during rotation of the tool head, the tool head longitudinal axis may be inclined to the tool housing longitudinal axis.

The first motor may comprise a first motor output shaft.

The second motor may comprise a second motor output shaft.

The first drive mechanism may be connected to the first motor output shaft by a first connection member.

The second drive mechanism may be connected to the second motor output shaft by a second connection member.

The first and second motors may be located within the tool housing.

In some embodiments, the first and second motors may be aligned along the tool housing longitudinal axis.

In these embodiments, the first and second motor output shafts may be adapted to rotate about the tool housing longitudinal axis.

The first and second connection members may be arranged concentrically.

One of the first or second connection members may define a throughbore adapted to receive the other of the first or second connection members.

One of the first or second connection members may define a chamber adapted to receive the motor connected to the other of the first or second connection members.

In a preferred embodiment, the first connection member connects the first motor output shaft to the first drive mechanism and defines a chamber in which the second motor sits. This puts the first and second motors in axial alignment, reducing the diameter of the tool itself.

In this embodiment, the second motor may be rotationally fixed to the first connection member.

In alternative embodiments, the first and second motor output shafts may be adapted to rotate about an axis parallel to the tool housing longitudinal axis.

In these alternative embodiments, the second motor may be rotationally independent of the first connection member.

Alternatively, one of the second motors may be located within the tool head.

The cutting tool may further comprise a third drive mechanism.

The third drive mechanism may be adapted to rotate the tool head. In such an embodiment, the rotation of the cutting element may be independent of rotation of the tool head.

The cutting tool may further comprise a third motor.

The third drive mechanism may be powered by the third motor.

The third motor may be located within the tool housing.

One or all of the motors may be powered by one of electrical means, pneumatic means or hydraulic means.

The cutting element cutting profile may define a single cutting-edge. For example, the cutting element may be a blade.

Alternatively, the cutting element cutting profile may define a multiple cutting-edge. For example, the cutting element may be a multi-toothed saw blade or a double edge drill or mill bit.

According to a second aspect of the present invention there is provided a cutting tool for cutting a tubular, the tool comprising:

a tool housing;

a tool head rotationally mounted to the tool housing;

a cutting element located within the tool head, the cutting element defining a cutting profile and being rotationally fixed to the tool head;

a first drive mechanism adapted to rotate the tool head, and a second drive mechanism adapted to control the displacement of the cutting element with respect to a surface to be cut;

wherein the first and second drive mechanisms are independently powered.

According to a third aspect of the present invention there is provided a cutting tool for cutting a tubular, the tool comprising:

a tool housing;

a tool head rotationally fixed to the tool housing;

a cutting element located within the tool head, the cutting element defining a cutting profile and being rotational with respect to the tool housing;

a first drive mechanism adapted to rotate the cutting element, and a second drive mechanism adapted to control the displacement of the cutting element with respect to a surface to be cut;

wherein the first and second drive mechanisms are independently powered.

According to a fourth aspect of the present invention there is provided a cutting tool for cutting a tubular, the tool comprising:

a tool housing;

a tool head rotationally mounted to the tool housing;

a cutting element located within the tool head, the cutting element defining a cutting profile and being rotational with respect to the tool head;

a first drive mechanism adapted to rotate the cutting element;

a second drive mechanism adapted to control the displacement of the cutting element with respect to a surface to be cut, and a third drive mechanism adapted to rotate the tool head;

wherein the first, second and third drive mechanisms are independently powered.

According to a fifth aspect of the present invention there is provided a method of cutting a tubular, the method comprising the steps of:

locating a cutting tool adjacent to the tubular to be cut;

utilising a first power source to energise a first cutting tool drive mechanism to advance a cutting tool cutting element towards the surface to be cut;

utilising a second power source, different from the first power source to energise a second cutting tool drive mechanism to rotate the cutting tool with respect to the surface to be cut.

The cutting tool may further include a cutting tool head, and rotation of the cutting element may be by rotation of the cutting tool with respect to the cutting tool head.

Where the cutting element is rotated with respect to the cutting tool head, the method may further comprise:

utilising a third power source to energise a third cutting tool drive mechanism to rotate the cutting tool head.

It will be understood that features listed as non-essential with respect to one aspect may be equally applicable to another aspect but have not been repeated for brevity.

BRIEF DESCRIPTION OF THE DRAWINGS

Embodiments of the present invention will now be described with reference to the accompanying drawings in which:

FIG. 1, comprising

DETAILED DESCRIPTION OF THE DRAWINGS

Figure 1A:
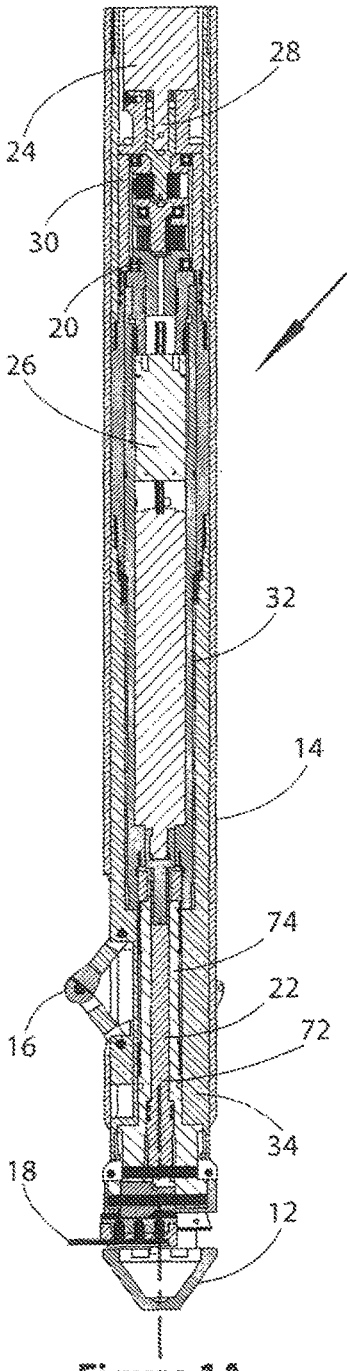
FIGS. 1A to 1C, are sections of a cutting tool for cutting a tubular according to a first embodiment of the present invention.
Figure 1B:
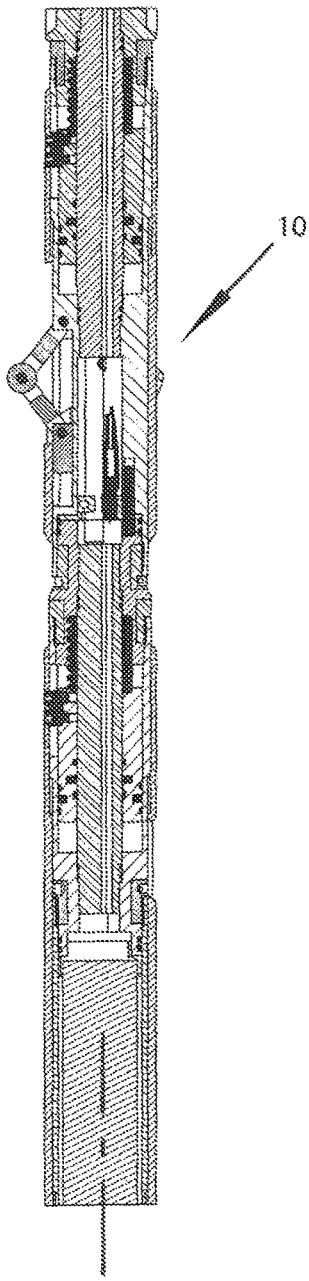
Figure 1C:
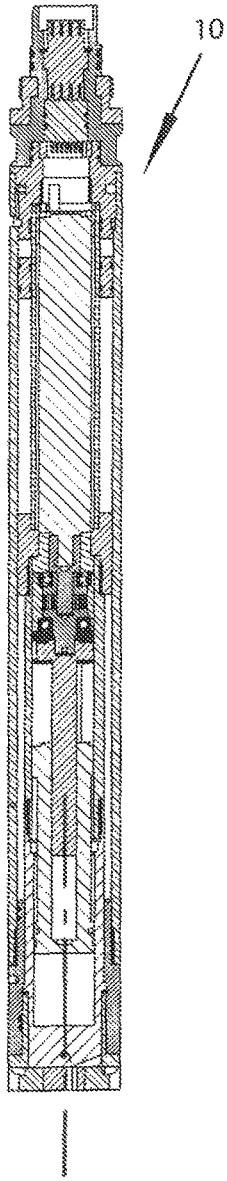

Referring to FIG. 1, comprising FIGS. 1A to 1C, there is shown a cutting tool, generally indicated by reference numeral 10, for cutting a tubular (not shown). The cutting tool 10 comprises a tool head 12 and a tool housing 14. The tool housing 14 includes an anchoring mechanism 16 for anchoring the cutting tool 10 within a tubular, which requires severance by means of cutting, and a roller centraliser to centralise the upper portion of the cutting tool 10 in alignment with the tubular longitudinal axis.

The cutting tool 10 is adapted to perform a circumferential cut through the tubular wall (not shown) by rotation of the tool head 12 with respect to the tool housing 14 and, particularly, the engagement of a cutting element 18 with the tubular wall.

The cutting tool 10 comprises a first drive mechanism 20 adapted to move the cutting element 18 in a cutting direction, or in this case to rotate the tool head 12 with respect to the tool housing 14. The cutting tool 10 further comprises a second drive mechanism 22 adapted to control the displacement of the cutting element 18 with respect to the tubular surface. Essentially, the second drive mechanism 22 brings the cutting element 18 into engagement with the tubular wall and, as required, advances the cutting element 18 as the circumferential cut is made. The second drive mechanism 22 can also retract the cutting element 18 back into the tool head 12 when the cut is complete and/or when the cutting tool 10 needs to be recovered to surface.

The first and second drive mechanisms 20, 22 are independently powered by a first drive motor 24 and a second drive motor 26 respectively. As can be seen from FIG. 1, the first and second drive motors 24, 26 are aligned axially along the tool housing 14.

Figure 2:
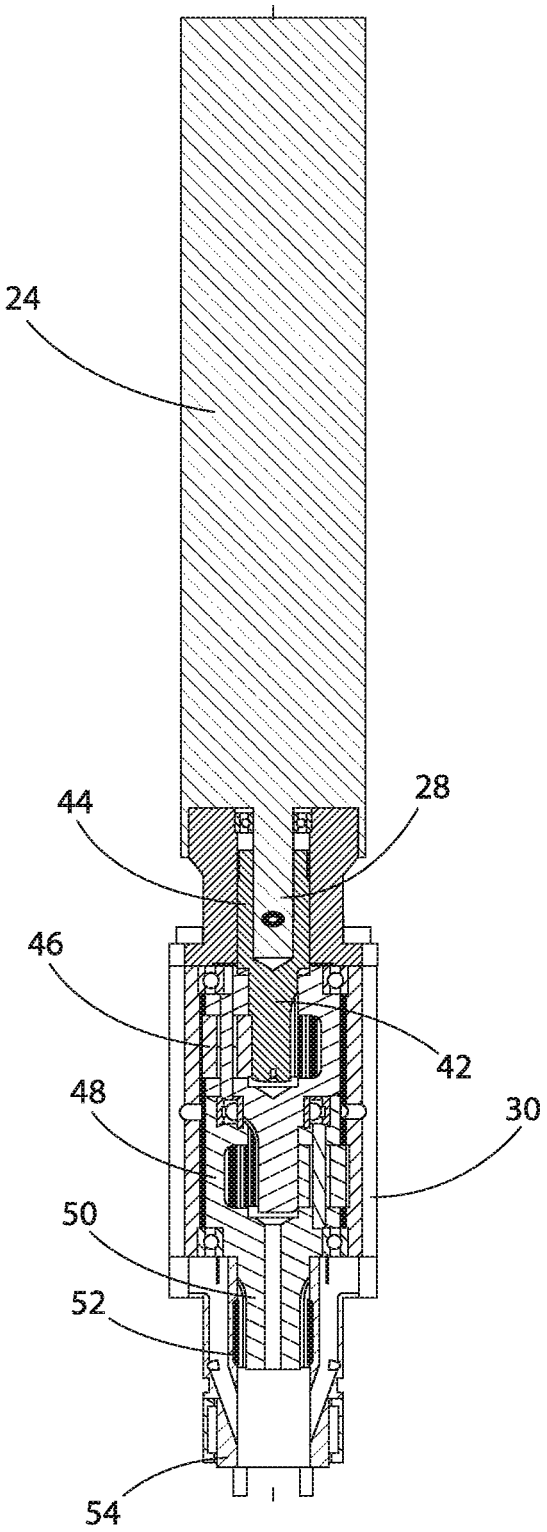
FIG. 2 is a section of part of the tool of FIG. 1 showing the first drive motor.

Referring additionally to FIG. 2, a section of part of the cutting tool 10 of FIG. 1 is illustrated showing the first drive motor 24. The first drive motor 24 has a first drive motor output shaft 28 which feeds into a gearbox 30. The first drive motor output shaft 28 is connected to a gearbox input gear 42 by means of a spline connection 44. The gearbox 30 has a first stage 46 and a second stage 48; the second stage 48 having an output shaft 50 which is connected by means of a spline 52 to a tool chamber drive 54. The tool chamber drive 54 is connected by a spline connection 56 to a tool chamber 32 (shown in FIG. 3, which is a section view of part of the tool of FIG. 1 showing the second drive motor 26).

Figure 3:
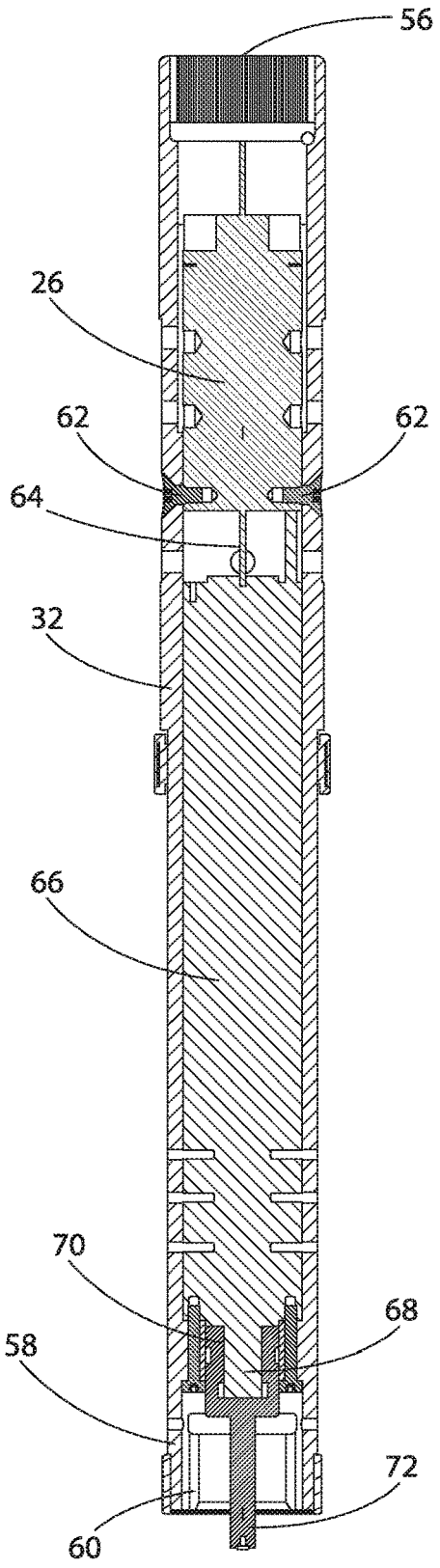
FIG. 3 is a section of part of the tool of FIG. 1 showing the second drive motor.

The gearbox 30 is operable to convert the rotation of the first motor output shaft 28 into a slower rotation of the tool chamber 32. Referring to FIG. 3, the tool chamber 32 terminates in a drive 58 defining an internal spline 60, which connects to a first drive mechanism driveshaft 34 (FIG. 1A), which drives the tool head 12 as will be discussed in due course.

Referring back to FIG. 3, the second drive motor 26 is located within the tool chamber 32 and is rotationally fixed to the tool chamber 32 by pins 62, such that the second drive motor 26 rotates with the tool chamber 32.

The second drive motor 26 has an output shaft 64 which drives a gearbox 66, which has a gearbox output shaft 68 connected by a spline connection 70 to a second drive mechanism driveshaft 72. As can be most clearly seen from FIG. 1A the second drive mechanism driveshaft 72 runs in a bore 74 defined by the first drive mechanism driveshaft 34.

Figure 4:
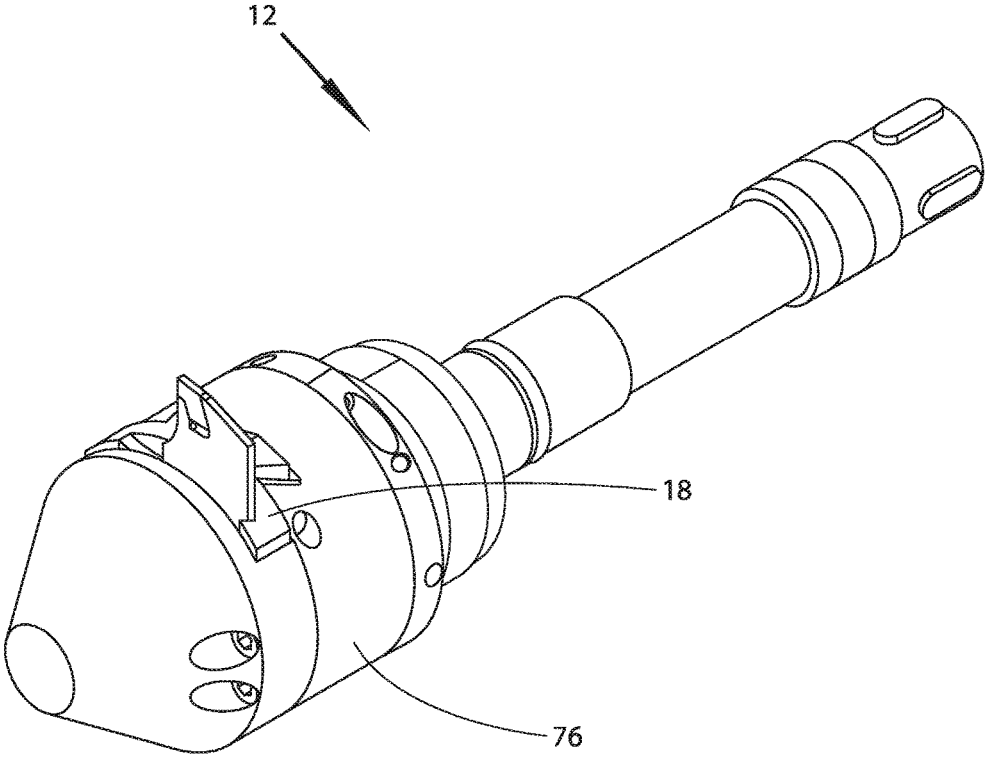
FIG. 4 is a perspective view of the tool head of the cutting tool of FIG. 1.
Figure 5:
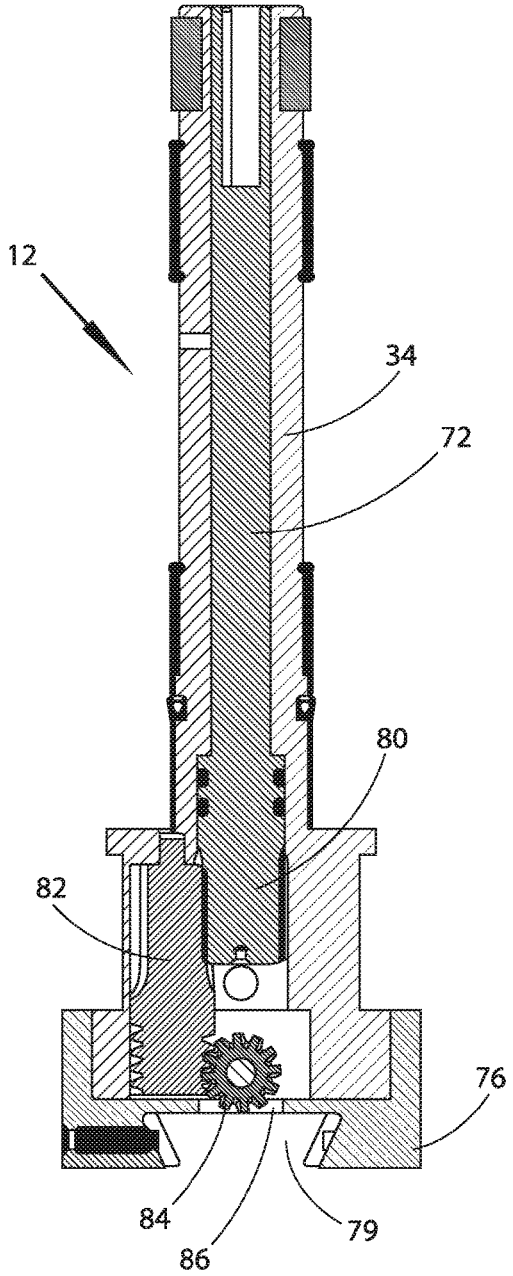
FIG. 5 is a section through part of the tool head of FIG. 4.
Figure 6:
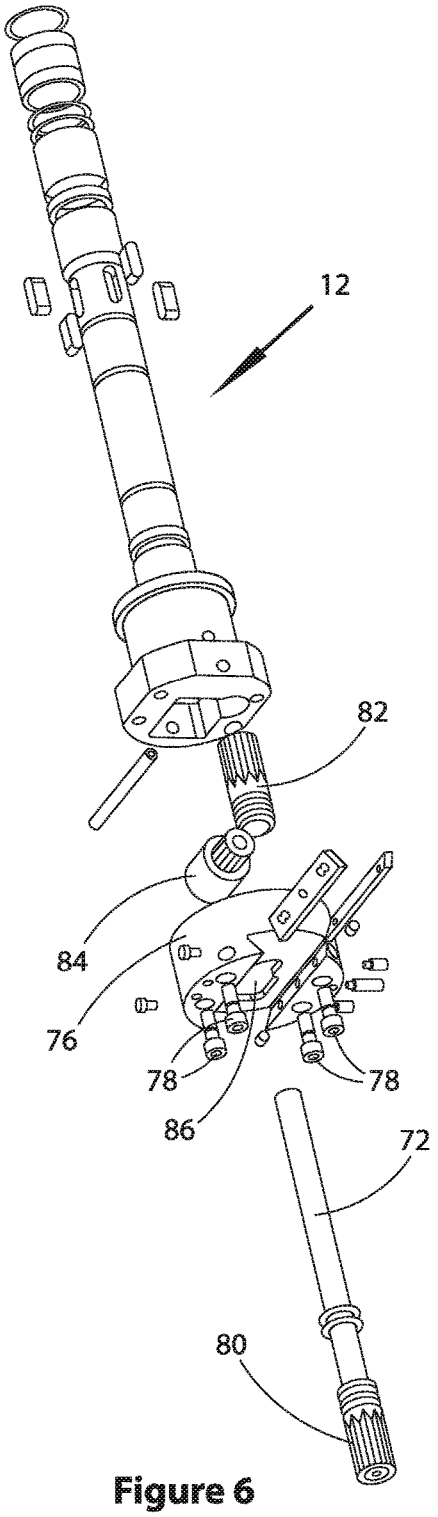
FIG. 6 is an exploded view of part of the tool head of FIG. 4.

Referring now to FIGS. 4, 5 and 6; a perspective view of the tool head 12 of the cutting tool 10 (FIG. 4); a section through part of the tool head 12 of FIG. 4 (FIG. 5) and an exploded view of the part of the tool head 12 of FIG. 4 (FIG. 6) are illustrated. In addition to the second drive mechanism driveshaft 72 and the first drive mechanism driveshaft 34, the tool head 12 further comprises a cutting element holder 76 which is rotationally fixed to the tool head 12 by means of screws 78.

The cutting element holder 76 defines a recess 79 for receiving the cutting element 18. The cutting element 18 (see FIG. 4) is secured to the tool head 12 in the recess 79.

Returning to FIG. 5, the second drive mechanism driveshaft 72 terminates in a splined end 80 which drives a first gear 82 and in turn a second gear 84.

Referring to FIG. 6, the cutting element holder 76 defines an aperture 86 which permits the cutting element 18 (see FIG. 4) to engage with the second gear 84 to control the movement of the cutting element 18 such that the cutting element 18 can advance or retract under the action of the second drive motor 26.

Independent drive motors 24, 26 on the cutting tool 10 allows the motors 24, 26 to perform different tasks without reliance on a single motor or have to operate a primary speed of the single motor. Particularly, the second drive motor 26 can advance or retract the cutting element 18 at high speed rather than at the slow speeds whilst the first drive motor 24 rotates the tool head 12.

Figure 7:
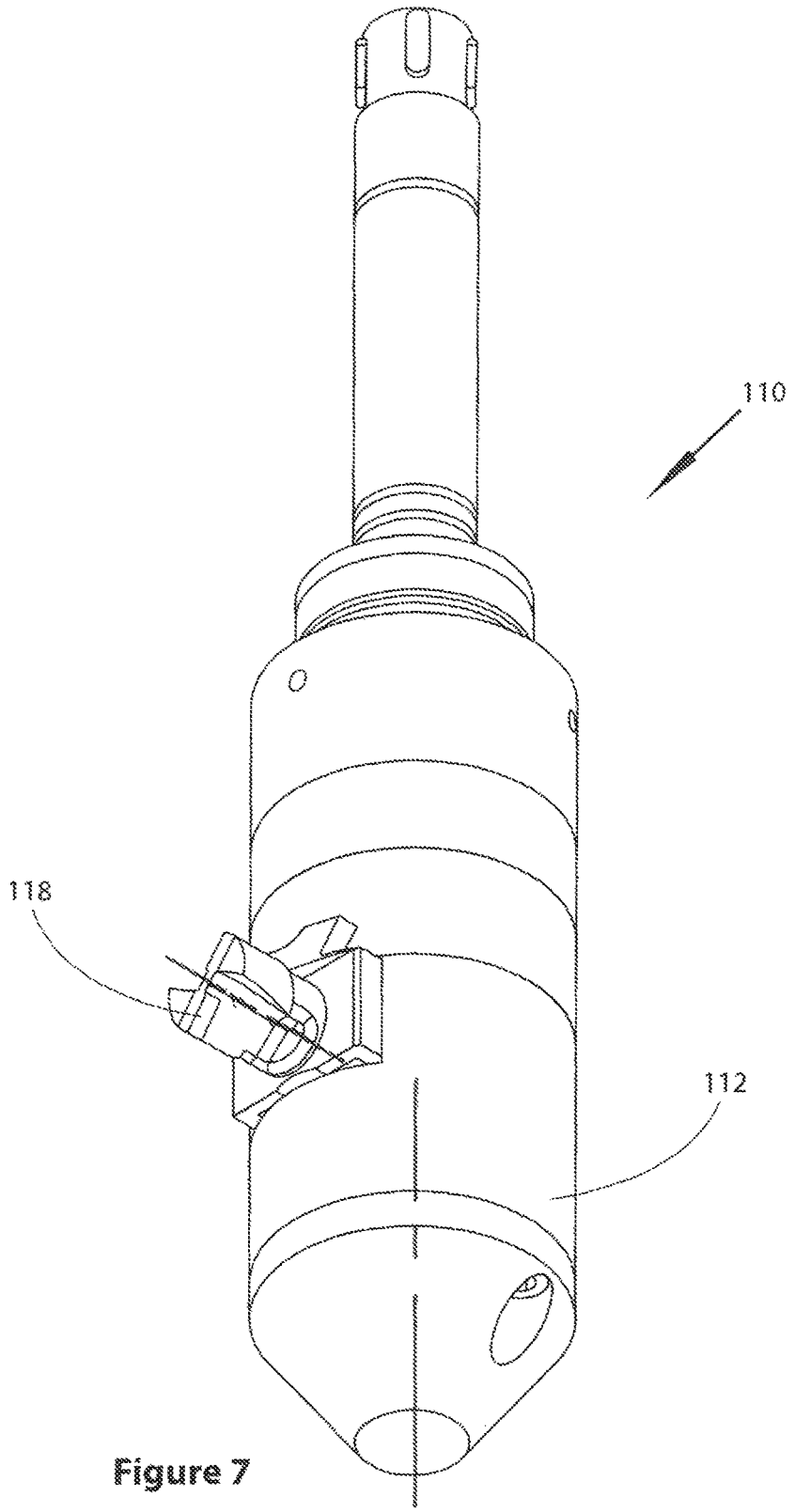
FIG. 7 is a perspective view of a tool head for a cutting tool for cutting a tubular according to a second embodiment of the present invention.

Reference is now made to FIG. 7 showing a perspective view of a tool head 112 for a cutting tool 110 for cutting a tubular (not shown) according to a second embodiment of the present invention.

Figure 8:
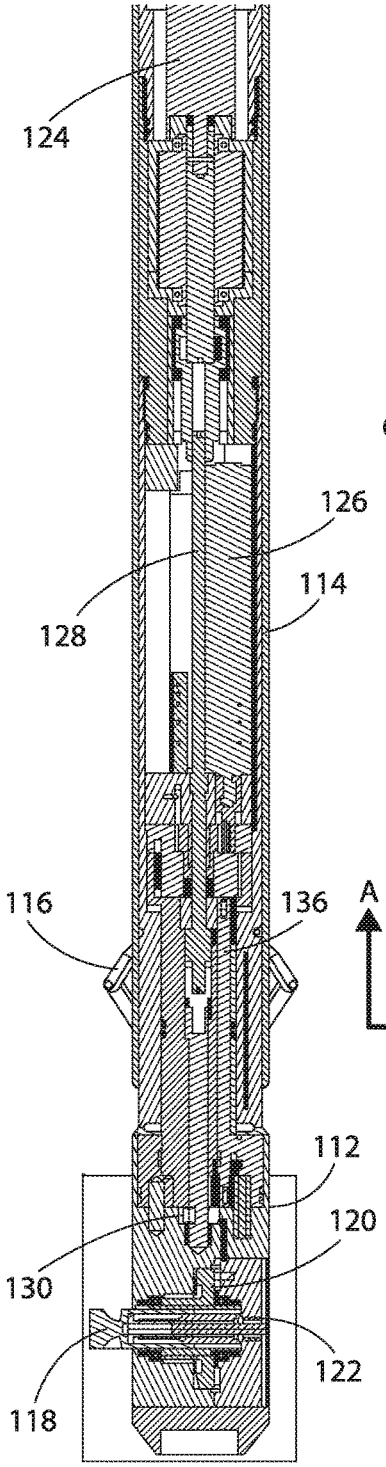
FIG. 8 is a section through part of the tool head of FIG. 7.

As illustrated in FIG. 8, the tool 110 further comprises a tool housing 114, The tool housing 114 further includes an anchoring mechanism 116 for anchoring the cutting tool 110 within a tubular, which requires a hole to be cut through the tubular wall.

The cutting tool 110 cuts a hole through the tubular wall by rotation of a cutting element 118 (see FIG. 7), in the form of a drill bit, with respect to the tool head 112.

The tool 110 comprises a first drive mechanism 120 adapted to rotate the cutting element 118 and a second drive mechanism 122 adapted to control the displacement of the cutting element 118 with respect to the tubular surface.

Essentially, the second drive mechanism 122 brings the cutting element 118 into engagement with the tubular wall and, as required, advances the cutting element 118 in a direction radially away from the tool head 112 as the cutting element 118 cuts through the tubular. The second drive mechanism 122 can also retract the cutting element 118 back into the tool head 112 when the cut is complete and/or the tool 110 needs to be recovered to surface.

The first and second drive mechanisms 120, 122 are independently powered by a first drive motor 124 and second drive motor 126 respectively.

Figure 9:
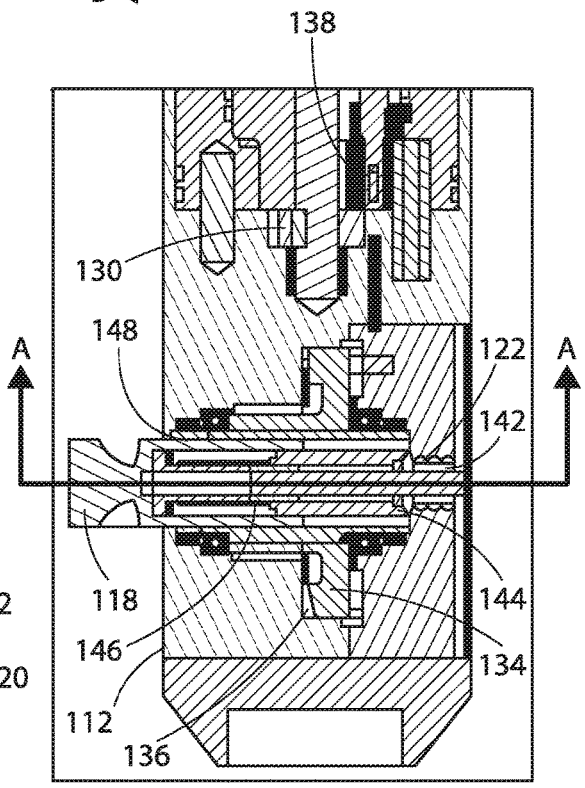
FIG. 9 is an enlarged view of part of FIG. 8.

The first drive motor 124 is connected to the first drive mechanism 120 by a drivetrain 128 which rotates a gear 130 in the tool head 112 (best seen in FIG. 9, which is an enlarged view of part of FIG. 8).

Rotation of the gear 130 drives a first mechanism shaft 132 (not visible on FIG. 8 or 9). The first mechanism shaft 132 in turn drives the first drive mechanism 120. The first drive mechanism 120 comprises a disc gear 134 defining a geared surface 136 which engages with the first mechanism shaft 132.

The disc gear 134 is rotationally fixed to the cutting element 118 such that rotation of the disc gear 134 by the first drive motor 124 results in rotation of the cutting element 118.

Figure 10:
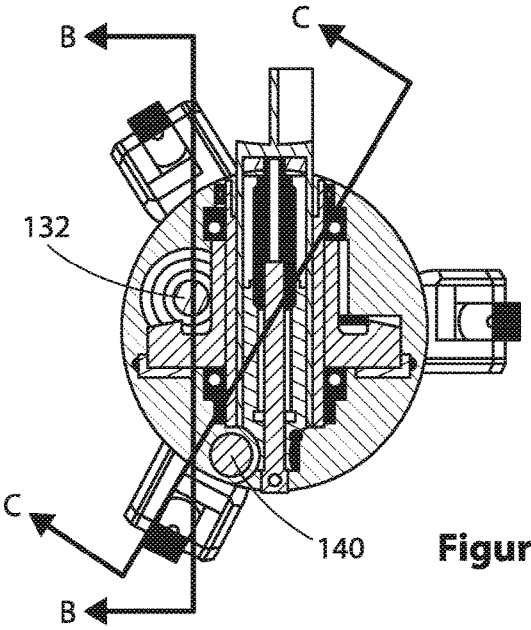
FIG. 10 is a section taken along line A-A of FIG. 9.

Referring to FIGS. 8, 9 and 10, the second drive motor 126 is connected to the second drive mechanism 122 by a drivetrain 136 which rotates a gear 138 in the tool head 112 (best seen in FIG. 9), which in turn drives a second mechanism shaft 140 (not visible on FIG. 8 or 9 but discussed in due course).

The second mechanism shaft 140 in turn drives the second drive mechanism 122. The second drive mechanism 122 comprises a gear 142 mounted to an axially extending sleeve 144, which extends into the cutting element 118. The extending sleeve 144 defines an external surface profile 146 which forms a threaded connection with a complementary profile 148 defined by a cutting element internal surface The second drive mechanism 122 can therefore be activated independently of the first drive mechanism due to the incorporation of separate first and second drive motors 124, 126. This allows for the movement of the cutting element 118, along its longitudinal axis towards the surface that is to be cut, to be independent from the rotational movement of the cutting element around its longitudinal axis to perform a cut.

Figure 11:
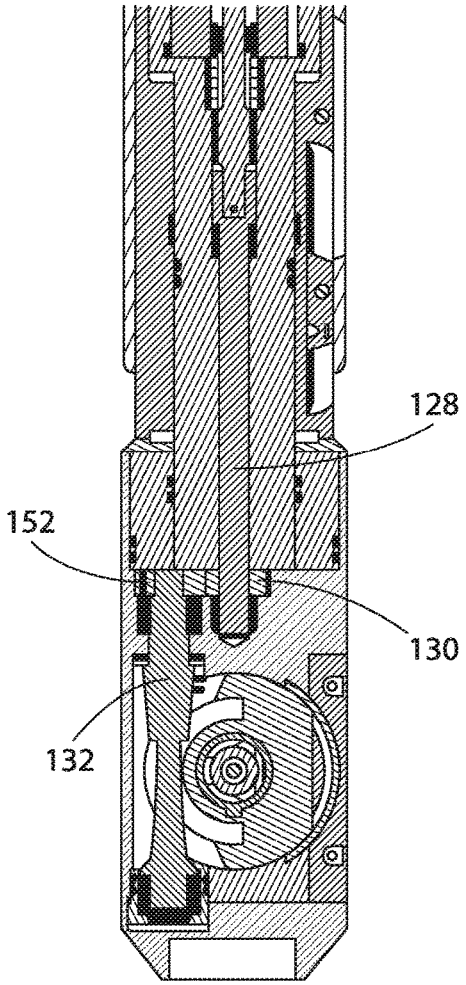
FIG. 11 is a section taken along line B-B of FIG. 10.
Figure 12:
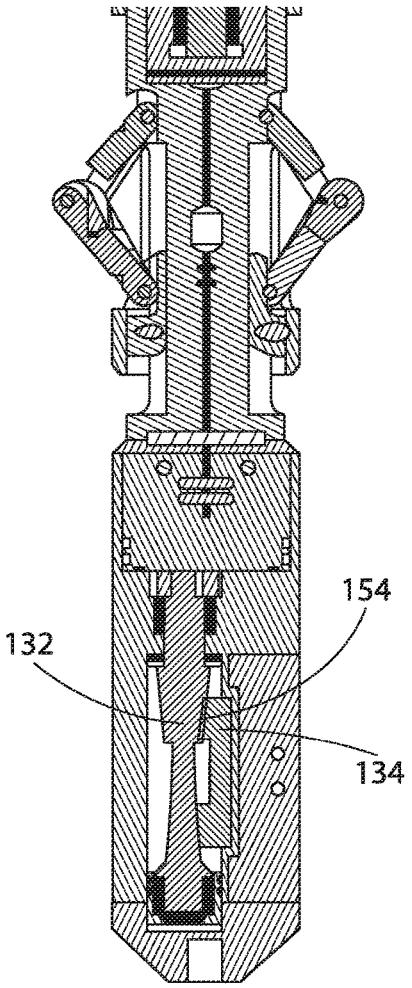
FIG. 12 is a section taken along line C-C of FIG. 10.

The internal arrangements and particularly the first and second mechanism shafts 132, 140 can be seen in FIGS. 10, 11 and 12.

Starting with FIG. 12, which illustrates a section taken along line C-C on FIG. 10, the first mechanism shaft 132 can be seen in section in engagement with the disc gear 134. Similarly, in FIG. 9, the second mechanism shaft 140 is also visible in engagement with the second mechanism gear 142.

Referring to FIG. 11, a section taken along line B-B on FIG. 10 and FIG. 12, a section taken along line C-C on FIG. 10. The first mechanism shaft 132 can be seen most clearly. In FIG. 11 the drivetrain 128 and the drivetrain gear 130 can be seen. The drivetrain gear 130 is shown in engagement with the first mechanism shaft gear 152. In the illustrated example, the first mechanism shaft gear 152 is fixed to the first mechanism shaft 132.

Referring to FIG. 12, the engagement between the first mechanism shaft 132 and the disc gear 134 can be most clearly seen through the interface 154 between the two components 132,134.

Figure 13:
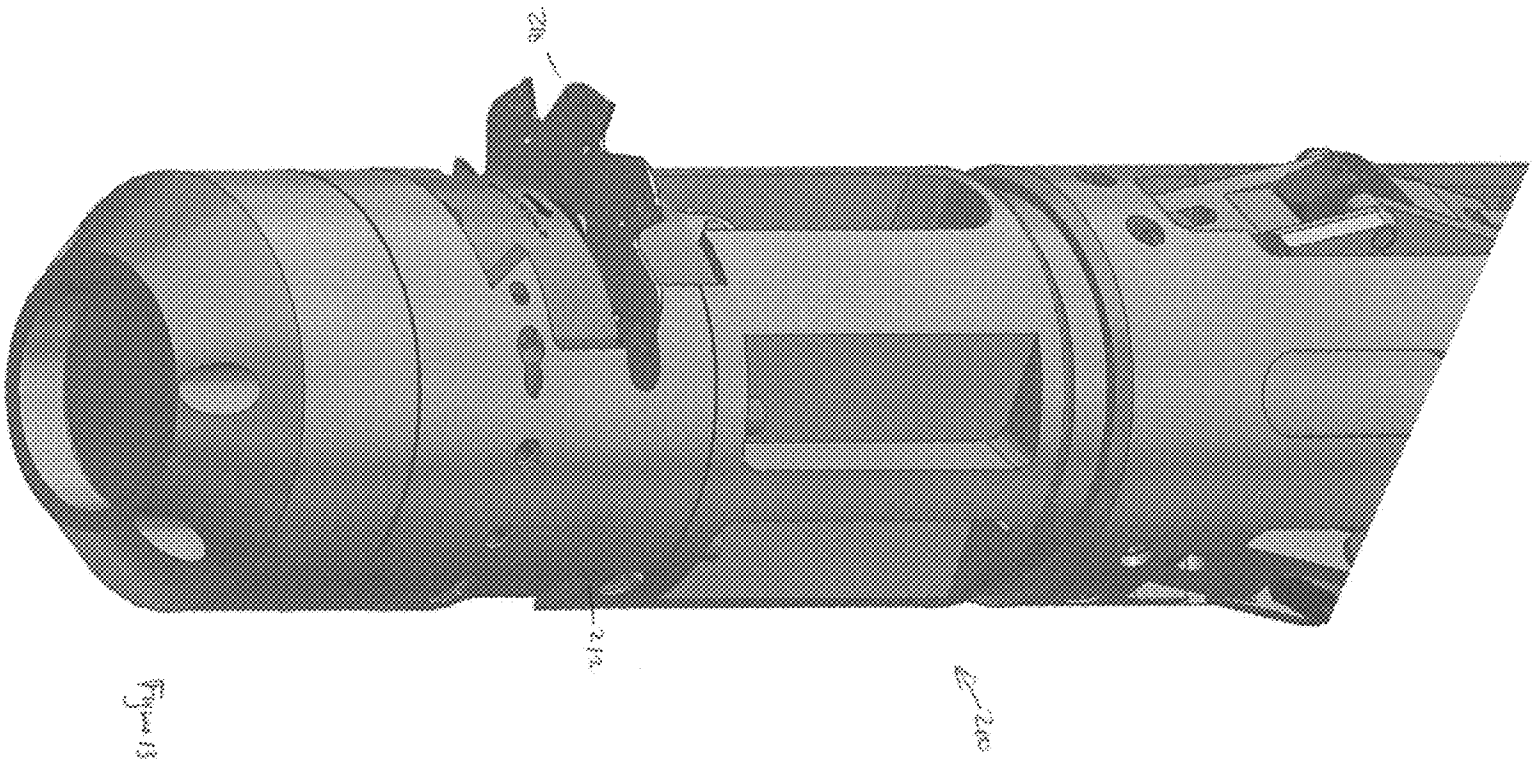
FIG. 13 is a perspective view of a tool head for a cutting tool for cutting a tubular according to a third embodiment of the present invention.

Reference is now made to FIG. 13, which shows a perspective view of a tool head 212 for a cutting tool 210 for cutting a tubular according to a third embodiment of the present invention.

The arrangement of the cutting tool 210 as illustrated in FIG. 13 is very similar to the cutting tool 110 of the second embodiment. The essential difference is the cutting element 218 is a circular blade adapted to spin around an axis parallel to the tool longitudinal axis.

Various modifications and improvements may be made to the above-described embodiments without departing from the scope of the invention. For example, the tool of the third embodiment could employ a third motor to permit the head to rotate independently of the mechanism to advance the blade towards the surface to be cut or the mechanism to rotate the blade. Such an embodiment has utility in that the blade could be advanced into engagement with the tubular surface and perform a cut through the tubular surface, also cutting any external control lines, for example, which may be attached to the external surface of the tubular. Once user is satisfied that the cut of sufficient depth has been achieved, the third motor could be activated to rotate the head to perform a cut around the full circumference of the tubular.

In other embodiments, the tool head maybe adapted to manoeuvre to a position where it is inclined at an angle to the tool housing.

The invention claimed is:

1. A cutting tool for cutting a circumferential cut through a tubular wall, the cutting tool comprising:

a tool housing having a longitudinal axis;

a tool head having a longitudinal axis and being rotationally mounted to the tool housing;

a cutting element holder, which is rotationally fixed to the tool head, the cutting element holder defining a recess in which a cutting element is received, the cutting element holder defining an aperture which permits engagement of the cutting element with a gear arrangement via the aperture from above the cutting element, the gear arrangement being operable to control radially advancing and retracting the cutting element during rotation of the tool head, wherein the cutting element does not rotate about its own central longitudinal axis and the cutting element defines a cutting profile which comprises a single cutting element, a first drive mechanism operable to rotate the tool head relative to the tool housing;

a second drive mechanism operable to control the displacement of the cutting element radially relative to the tool head and to a surface to be cut;

and wherein simultaneous rotation of the tool head and radial advancement of the cutting element from the tool head during rotation of the tool head create a circumferential cut through a surface of the tubular.

2. The cutting tool according to claim 1 further comprising:

a first motor and a second motor, wherein the first drive mechanism is powered by the first motor and the second drive mechanism is powered by the second motor.

3. The cutting tool according to claim 1, wherein the cutting element is elongate and wherein the elongate cutting element defines a cutting element longitudinal axis.

4. The cutting tool according to claim 1, wherein the cutting element is elongate and wherein a longitudinal axis of the cutting element is perpendicular to the tool housing longitudinal axis.

5. The cutting tool according to claim 1, wherein the cutting element is planar.

6. The cutting tool according to claim 1, wherein the tool head is releaseably connectable to the tool housing.

7. The cutting tool according to claim 1 wherein, during rotation of the tool head, the tool head longitudinal axis is the same as the tool housing longitudinal axis.

8. The cutting tool according to claim 2, wherein the first motor comprises a first motor output shaft and the second motor comprises a second motor output shaft and wherein the first drive mechanism is connected to the first motor output shaft by a first connection member and the second drive mechanism is connected to the second motor output shaft by a second connection member.

9. The cutting tool according to claim 2, wherein the first and second motors are located within the tool housing.

10. The cutting tool according to claim 2, wherein the first and second motors are aligned along the tool housing longitudinal axis.

11. The cutting tool according to claim 8 wherein the first and second connection members are arranged concentrically and wherein one of the first or second connection members defines a throughbore operable to receive the other of the first or second connection members.

12. The cutting tool according to claim 11 wherein one of the first or second connection members defines a chamber operable to receive the motor connected to the other of the first or second connection members.

13. The cutting tool according to claim 8, wherein the second motor may be rotationally fixed to the first connection member.

14. The cutting tool according to claim 8, wherein the second motor is rotationally independent of the first connection member.

* * * * *